US005456197A

United States Patent [19]

Kwok

[11] Patent Number: 5,456,197

[45] Date of Patent: Oct. 10, 1995

[54] BARGE

[76] Inventor: Ching W. Kwok, 7 Nam Ning St., 18/F., Flat 1, Aberdeen Centre, Hong Kong

[21] Appl. No.: 331,933

[22] Filed: Oct. 31, 1994

[30] Foreign Application Priority Data

Mar. 1, 1994 [GB] United Kingdom ..... 9403882

[51] Int. Cl.[6] ..... B63B 1/00

[52] U.S. Cl. ..... 114/56; 114/270

[58] Field of Search ..... 114/270, 56; 210/170, 210/242, 923

[56] References Cited

U.S. PATENT DOCUMENTS 3,822,789 7/1974 Crisafulli ..... 210/923

5,173,182 12/1992 Debellian ..... 210/923

*Primary Examiner*—Jesus D. Sótelo

*Attorney, Agent, or Firm*—Griffin, Butler, Whisenhunt & Kurtossy

[57] ABSTRACT

A barge-like vessel for removing floating debris from harbours and canals includes a powered barge section and a front mounted collection basin. The collection basin is substantially the same width as the barge and includes a front opening so that debris floating in the water will pass into the inlet opening as the vessel proceeds across the water. Surface water entering the inlet opening passes through a meshed collection basket and exits aft of the collection basin and ahead of the hull. The vessel includes a haulage system comprising a track so that the collection basket may be lifted from the skimming or collection position and moved rearwardly to dump contents into a hold in the vessel. The track which supports the collection basket during movement may include a switch section so that the basket may be emptied in optional positions by opening the switch section.

12 Claims, 4 Drawing Sheets

BARGE

FIELD OF THE INVENTION

This invention relates to debris removal equipment and in particular to a vessel for removing floating debris from restricted width waterways such as canals and the like, as well as for removing debris from open areas such as harbours, sea approaches and the like.

In many instances floating debris has become a problem. In crowded harbours such as Hong Kong, the degree of floating refuse pollution within the harbour is becoming unacceptable to users of the harbour. Similarly, when freeing rivers and canals from vegetation growth one of the first steps often involves cutting vegetation through some type of underwater cutting apparatus. The cut vegetation then floats to the surface where it must be picked up. If the vegetation is left to rot this will cause oxygen depletion of the water in the canal system or river and may lead to further unacceptable pollution.

Although many attempts have been made to provide vessels for collection of floating refuse, these vessels often have various limitations which make them unsuitable for use in busy crowded areas such as harbours, which because of their very high marine usage comprise a spread out area, but in respect of which there are many narrow areas and slips in which debris collects. Thus, there is a need to pick up debris in open area of harbours as well as a need to pick up debris in more restricted spaces such as in slips, near docks and wharfs and the like.

Most vessels which have been provided to collect floating debris must be provided with a storage area into which the floating debris is collected. When operating in very restricted areas such as canals or riverways and the like it may be possible to discharge the collected debris directly onto the bank of the canal. However, when operating in larger open areas such as harbours and the like, it is necessary to store the collected debris on board the vessel until such time as the vessel is full. When the vessel is full, the vessel is then manoeuvred to a discharge point which may be along side a dock, pier or bank and the collected material is then removed from the vessel. This in turn gives rise to the problem of how to distribute the collected material from its collection point to the storage point on the vessel. In some cases conveyor means and the like are used to distribute collected debris over a storage area. This then involves additional apparatus beyond that required to collect the floating material to move it from the collection point to a discharge point from the collection apparatus and then to move it from the collection discharge point to the storage point on the vessel. Because this often involves use of two different conveying systems this adds expense to the vessel.

In accordance with the present invention there is provided a vessel having a hull and a collection basin mounted at one end of the hull. The hull is provided with propulsion and steering means such as a motor, propeller and rudder. The collection basin is attached to the hull at the front. The collection basin defines an inlet opening for receiving floating debris. Relief means is provided between the collection basin and the hull so that water flowing into the inlet opening of the collection basin is allowed to exit aft of the collection basin ahead of the hull. A collection basket comprising at least one wall having a meshed opening through which water may flow is provided. The floating debris is then collected against the meshed surface. When the collection basket is full the basket is elevated and translated by haulage means to move the basket to one of a plurality of storage holds. The haulage means includes a track having one or more switch sections to enable the basket to be emptied into one or more storage holds.

These and other features of the present invention will become more clear by reference to the following drawings and description of a preferred embodiment of the invention.

Figure 1:
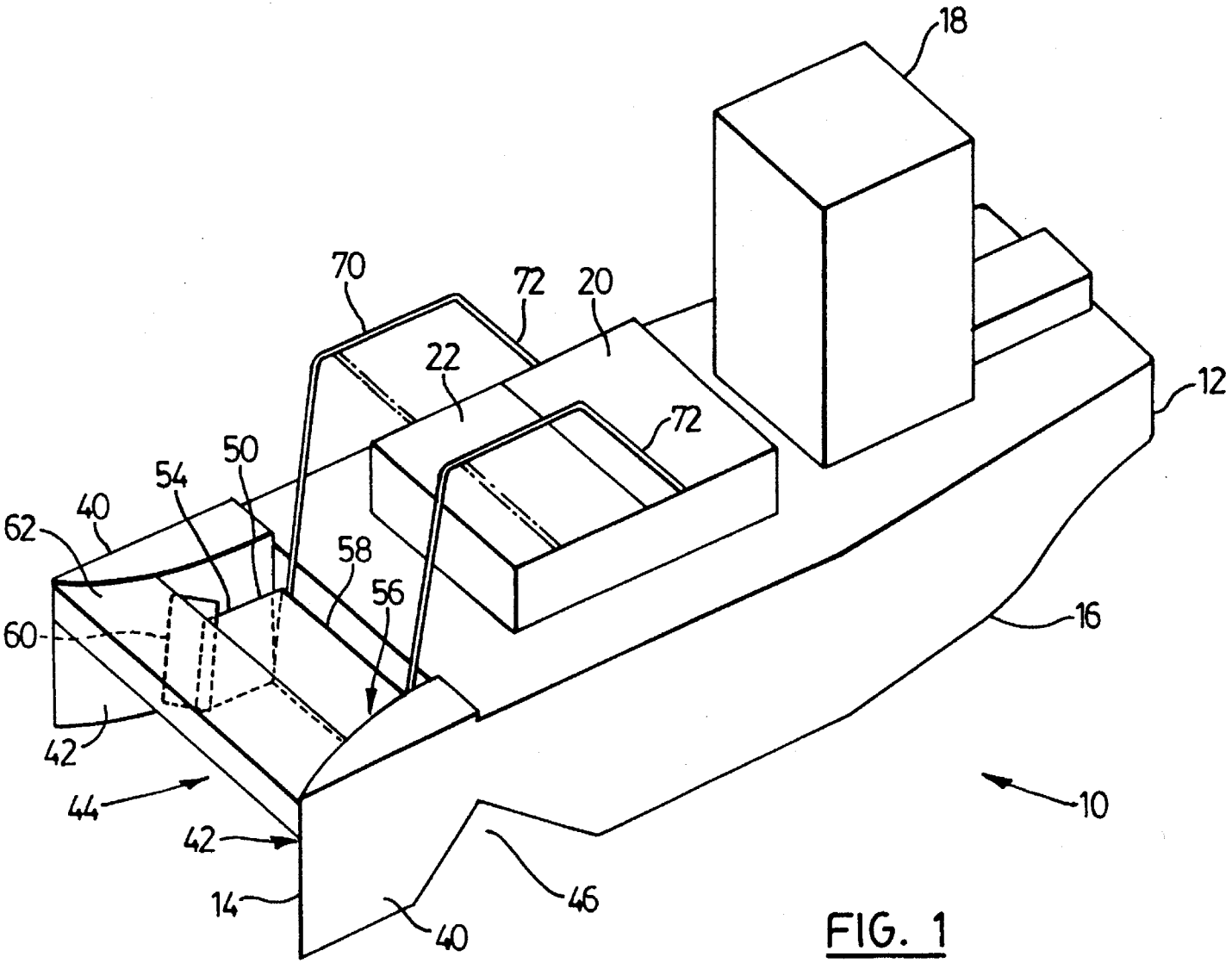
FIG. 1 illustrates a schematic view of the vessel in perspective from above in accordance with a preferred embodiment of the invention.

With reference to FIG. 1 the vessel is shown generally at 10. The vessel comprises a barge section 12 and a collection basin 14. The barge section 12 comprises a hull 16, an operator console 18 and two storage holds 20 and 22.

Figure 2:
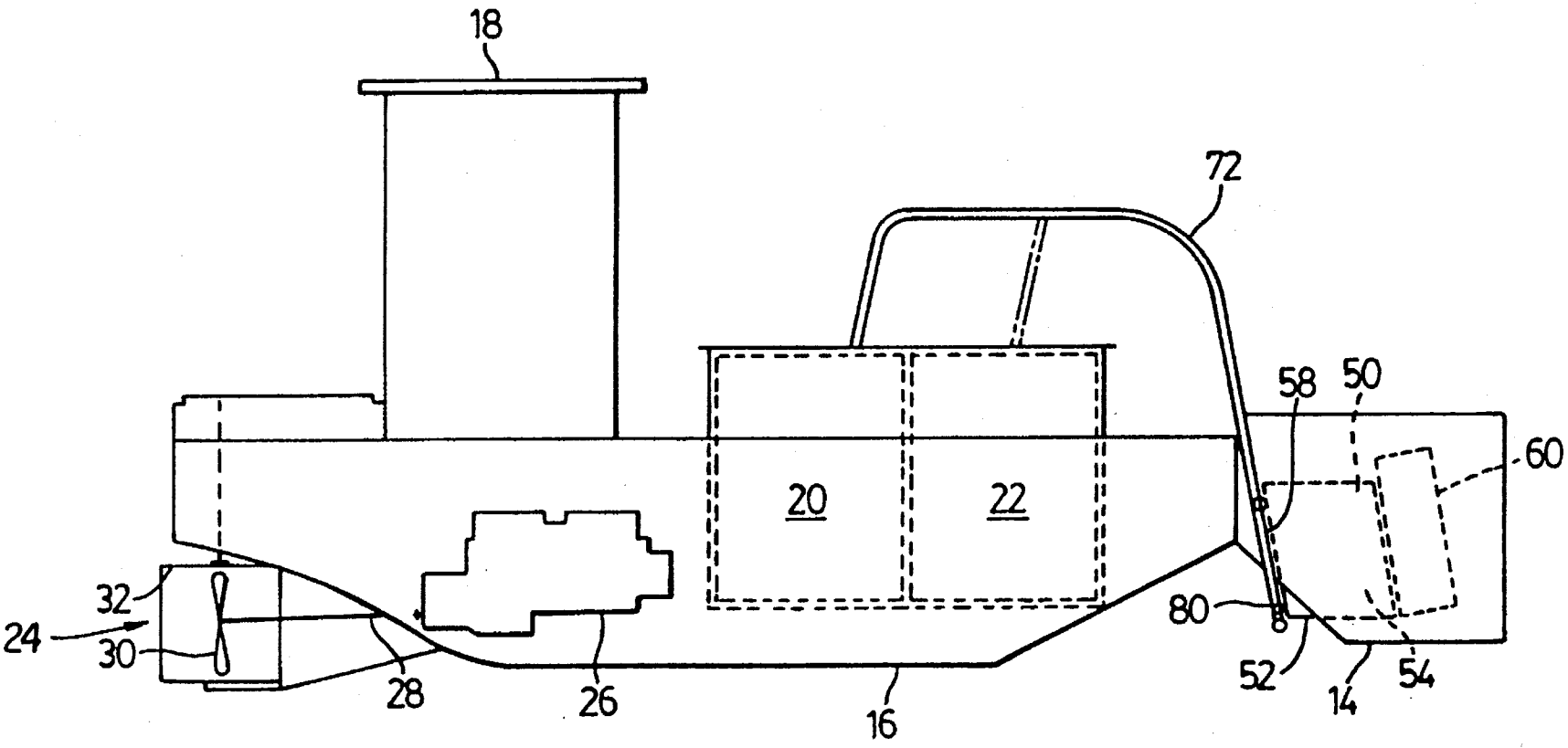
FIG. 2 illustrates the vessel of FIG. 1 in side profile view.

With reference to FIG. 2 it will be noted that the vessel is fitted with propulsion means indicated generally at 24 comprising a motor 26, a propeller shaft 28 and a propeller 30. A rudder 32 is fitted for steering the vessel.

The hull 16 of the vessel may be made from welded plate steel or other suitable materials such as wood or fibreglass. Generally the hull will be generally rectangularly shaped with the broadest portion or beam in the region of the storage hold 20 and 22. The aft portion of the hull may be narrowed slightly to enhance the fluid dynamics for efficient propulsion of the hull through the water.

The collection basin 14 may also be manufactured from steel plates welded together or wood or fibreglass or other suitable materials. Most preferably the collection basin comprises outside walls 40 which are aligned with the sides of the hull and the same beam measurement as the hull.

It is preferable that the collection basin be of substantially the same beam width as the hull. This facilitates the largest opening through which floating debris may be drawn into the collection basin while not providing a collection basin which is broader than the vessel itself. If the collection basin in substantially broader than the beam of the hull the storage capacity of the hull may be reduced as compared with a vessel with a wider beam. It is most efficient if the outside wall 40 of the collection basin is substantially aligned with the hull 16, providing the largest inlet opening while at the same time maximizing the relative storage area on the hull.

The collection basin 14 also comprises a pair of inside walls 42 which define an inlet opening 44. The inside walls preferably curve inwardly from the leading edge of the outside wall 40. The curved edge of the inside wall promotes efficient flow of water into the inlet opening and provides for the most efficient propulsion of the vessel through the water.

The vessel also contains relief means indicated generally at 46. In this preferred embodiment the relief means comprise a pair of openings one on either side of the aft section of the collection basin ahead of the bottom of the hull 16. Water flowing into the inlet opening may thus pass downwardly and under the hull or pass to port and starboard out through the relief openings 46. This promotes efficient flow of surface water into the inlet opening 44 and outward flow of the surface water as the vessel moves forward through the water.

In order to collect floating debris which floats into the inlet opening 44 the vessel is fitted with a collection basket 50. The collection basket 50 comprises a bottom surface 52, two side walls 54 and 56 and a back 58. Advantageously, all of bottom 52, side walls 54 and 56 and back 50 are mesh-like surfaces to provide a strainer-like effect. Water flowing into the inlet opening 44 as the vessel moves through the water is urged to flow into the collection basket 50 and then through one of the meshed surfaces 52, 54, 56 or 58. The surface water passes through with relatively little resistance while all floating materials are caught by the mesh.

The collection basket 50 is intended to be emptied from time to time and thus does not provide a tight fit against the inside walls 42 of the inlet opening. In order to collect floating debris which may pass directly along the inside walls 42 of the inlet opening two auxiliary collectors 60 are provided, one on each inside wall 42. The auxiliary collectors are also meshed surfaces through which the surface water may flow but which retain floating debris.

With the apparatus as described, all of the surface water immediately in front of the width of the vessel as measured by the beam will flow into the inlet opening 44 and then either through the collector basket 50 or the auxiliary collectors 60. All floating debris passing into the inlet opening is thus retained on either the auxiliary collectors 60 or in the collection basket 50.

The collection basin 14 is advantageously fitted with a work platform 62 extending across the outside walls 40. The work platform 62 is useful for two quite separate purposes. During the collection phase, if desired, a worker may stand on the work platform 62 and help steer all floating debris into the inlet opening as the vessel moves forward. The worker may also from time to time rearrange floating debris in the collection basket 50 or on the auxiliary collectors 60 so as to maximize the amount of time that the vessel may be propelled forwardly through the water before emptying the collection basket. An additional feature of the work platform 62 is its assistance during the unloading phase. In some situations the unloading may be accomplished directly from the front of the vessel. When the vessel is unloaded from the front, the work platform may be the area next adjacent to the pier against which the vessel is docked. A worker positioned there can then facilitate the use of a crane or other shore mounted facility which is used to remove the collected debris from the holds of the vessel.

It will be noted from reference to FIGS. 1 and 2 that the work platform 62 does not extend fully aft of the collection basin. There is an opening overlying the collection basket 50 so that the basket 5 may be elevated in front of the hull 16 and aft of the work platform 62.

Figure 3:
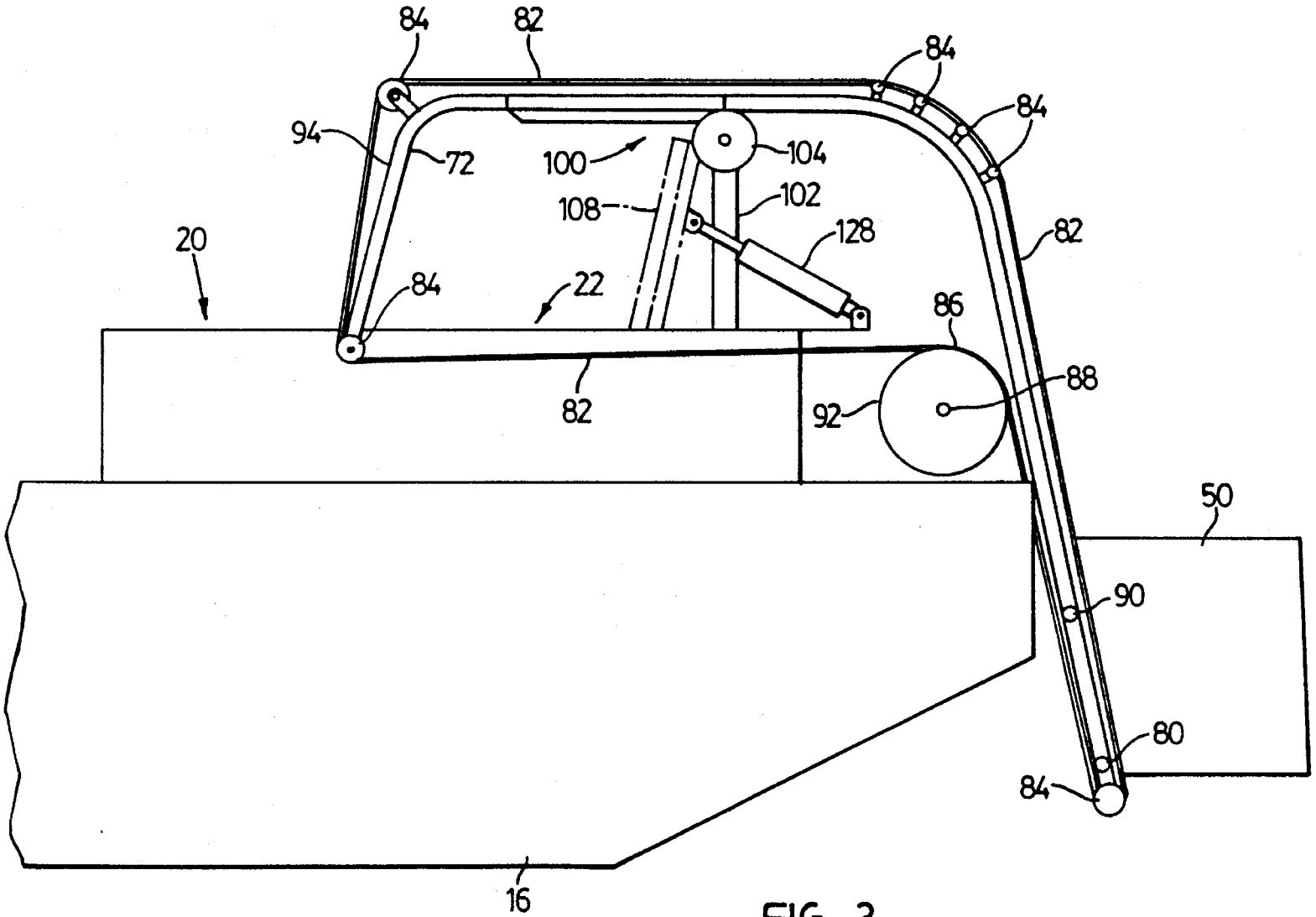
FIG. 3 illustrates the haulage mechanism of FIGS. 1 and 2.

The barge section 12 of the vessel is fitted with a haulage means 70. The haulage means is used to move the collection basket 50 from a first collection or skimming position as shown in FIGS. 1 and 2 to empty the collection basket in a second unloaded position so that debris collected may be stored in the holds 20 and 22. As shown in FIG. 3 the haulage means 70 comprises a track having a pair of rails 72, one on either side of the vessel. The rails 72 are an open box section as shown in FIG. 4A and comprise a support flange 74, a guide flange 76 and a top flange 78. The track extends upwardly from the bottom of the collection basket when it is in its collecting position as shown in FIGS. 1 and 2, substantially vertically upwardly and then aft to adjacent the aft storage hold 20. The collection basket 50 is fitted with a pair of wheels 80 one on either side of the collection basket 50 adjacent the intersection between the bottom 52 and the back 58. The wheels 80 are captured within the rails 72 and are supported for movement along the track by the support flange 74 and guided by the guide flange 76 and top flange 78.

In order to raise the collection basket from its collecting position as shown in FIGS. 1 and 2 to empty the collection basket,a pair of cables 82 are attached to the collection basket 50 on either side adjacent the wheels 80. Each cable 82 is guided for movement along the track by a plurality of cable idler pulleys 84 as shown in FIG. 3. Each cable 82 extends from the lower aft-most cable idler pulley 84 forwardly to a drive pulley 86 adjacent the forward end of the hull 16. The pair of cable drive pulleys 86, one located on each side of the vessel may be attached by a drive axle 88. An electric motor 92 can then be used to power each of the cable drive pulleys 86 to cause movement of the cables and lifting and translation of the collection basket 50.

The collection basket 50 is also fitted with a leading pair of wheels 90 located approximately half way up the back 58 of the collection basket. The wheels 90 also ride along the rails 72. The basket 50 thus moves substantially vertically upwardly as the cable moves along the cable idler pulleys. As the basket moves along the substantially horizontal section of the track, the back 58 supports the materials retained in the basket and the back is supported upon the pair of wheels 80 and the pair of leading wheels 90. When the leading wheels 90 approach the downwardly aft section of the track as shown in FIG. 3, the back 58 of the collection basket 50 will be moved to the substantially vertical position once the wheels 80 are on section 94 of the rail 72. At this time the contents of the collection basket 50 will be discharged into the aft storage hold 20. The motor driving the cables can then be reversed to return the collection basket to the initial skimming position. The basket can be cycled back and forth several times until the aft storage hold 20 is filled.

When the aft storage hold 20 is filled, the next storage hold 22 may be filled with additional cycles of the collection basket 50. In order to deliver the contents of the collection basket 50 to the forward storage hold 22, each rail 72 is fitted with a switch section 100. The switch section 100 is shown in FIGS. 3, 4, 5 and 6.

The switch section 100 comprises a switch support 102 which serves to support the rail 72 intermediate the two substantially vertical sections. The switch section 100 comprises a switch plate 104 which is pivotally attached to the switch support 102 at a pivotal connection 106. The switch section also includes a section of alternate rail 108. The alternate rail 108 is fixed to the switch plate 104. The alternate rail comprises a support flange 110 and a guide flange 112. The alternate rail may also include a stiffening rib 114 which serves to stiffen the alternate rail section 108.

Figure 5:
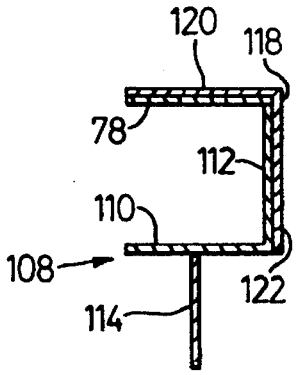
FIG. 5 illustrates the section 5—5 in FIG. 4.

Advantageously the track also includes a stiffening angle 118 on each rail 72. As shown in FIG. 5 the stiffening angle 118 includes an upper flange 120 which overlies flange 78 and a vertical flange 122 which backs up flange 76. The stiffening angle section 118 gives continuity to the rail 72 and permits the switch section 100 to be selectively positioned. If desired, the switch section 100 may be held in aligned configuration by means of a lock tab 124 and pin 126 passing through rib 114. To pivot the switch section 100 the pin 126 would be removed and the switch section rotated by hand. Alternatively, mechanical assist such as a hydraulic cylinder may be used.

In order to control location and pivotal movement of the alternate rail sections 108 in the preferred embodiment a hydraulic ram 128 is connected between the alternate rail 108 and the hull 16. The hydraulic ram 128 can be operated to pivot the alternate rail between the aligned position as shown in FIG. 4 and the alternate position as shown in FIG. 6.

Figure 4:
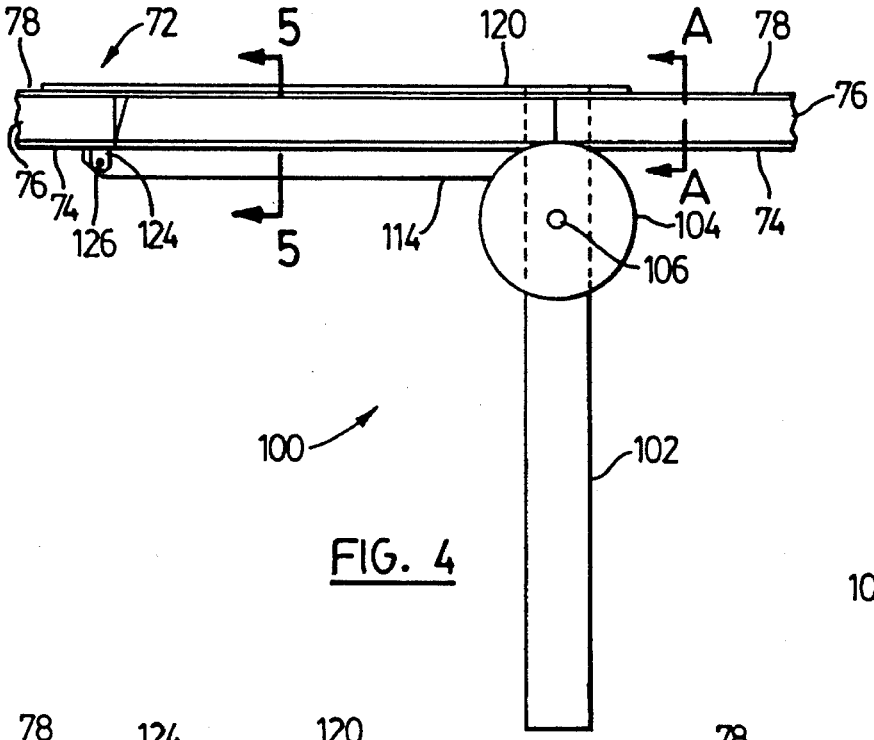
FIG. 4 illustrates a portion of the track section of the haulage means.
Figure 4A:
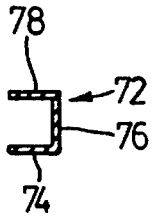
FIG. 4A illustrates the section A—A in FIG. 4.

When the alternate rail 108 is in the aligned position as shown in FIG. 4, then the leading wheels 90 and the wheels 80 of the collection basket will each pass along the rail 72. In so doing, the wheels will pass along the rail 72, along the support flange 110 of the switch section and then again back onto the support flange 74 of the rail 72 until the basket dumps into the aft hold 20.

Figure 6:
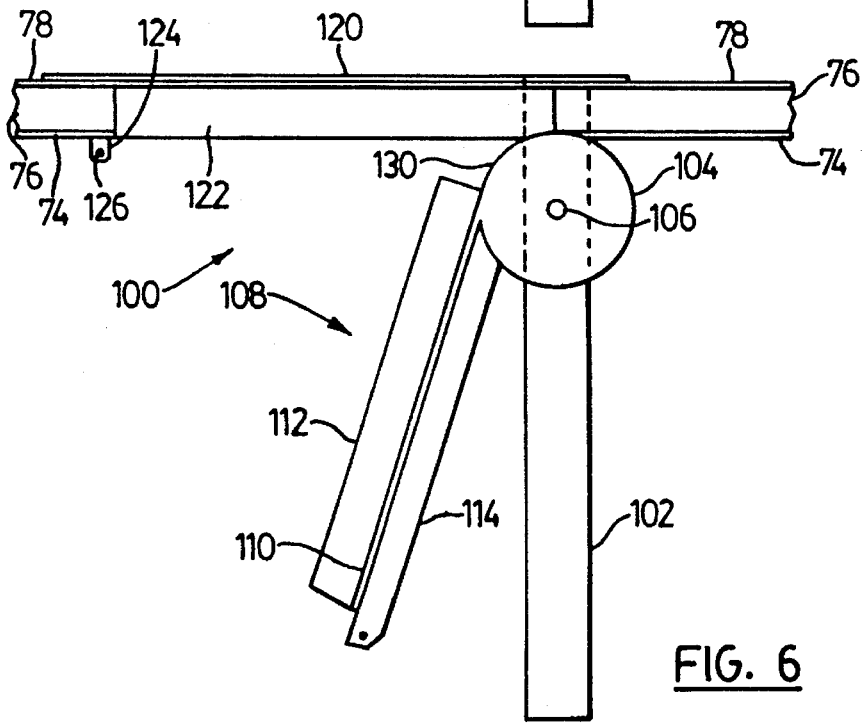
FIG. 6 illustrates the portion of the track section of FIG. 4 with the switch opened to empty the basket in an alternate hold.

When it becomes desirable to dump the collection basket 50 into the hold 22, the hydraulic ram 128 is operated to move the alternate rail section to the position shown in FIG. 6. The leading wheel 90 of the collection basket 50 will then travel along the support flange 74 of the track until the leading wheel 90 reaches the switch support 102. At the time that the leading wheel 90 arrives at the switch support 102 it will roll off the support flange 74 and roll along the guide surface 130 of the switch plate 104. It will then pass from the guide surface 130 of the switch plate 104 to the support flange 110 of the alternate rail. As the wheel 80 approaches the switch support 102 it will also begin to follow along guide surface 130. At this point, the back 58 of the collection basket 50 will be substantially vertical and the material retained in the collection basket will then be discharged by gravity into the forward hold 22.

In order to ensure that the upper end of the back 58 may deviate from the rail 72 and follow along the alternate rail 108, each cable 82 is attached to the collection basket 50 at the lowermost portion of the back 58, that is adjacent the wheels 80. This means that although the cable will continue to travel parallel to the rails along the several cable idler pulleys 84, the basket can be dumped into either hold 20 or 22 as desired.

When the holds 20 and 22 are filled, then the vessel ceases any further collection of floating debris and returns to its discharge facility. In order to most easily discharge the materials collected in holds 20 and 22, the holds are fitted with baskets which are not shown. These baskets are removed vertically upwardly from the holds 20 and 22 by means of shore mounted crane or other lifting facilities. During the emptying operation the collection basket 50 is in the position shown in FIGS. 1 and 2. Once the holds 20 and 22 have been emptied the vessel then returns to the collection operation.

With the preferred embodiment described herein a vessel can be operated by one man. The operator can drive the vessel from the operator console 18 which may be enclosed to protect the operator from the elements. As the vessel moves forward through the water, the operator steers the vessel to gather as much floating debris as possible. When the basket appears to be filled the vessel is stopped and the operator cycles the motor 92 to lift the collection basket 50 and translate it along the track to be unload into hold 20 or 22 as desired. When the collection basket is returned to its skimming position the vessel is then driven forward through the water to collect more debris.

If an auxiliary operator is available then the auxiliary operator may be stationed toward the front end of the vessel utilizing the work platform 62 and a pole so as to gather material into the collection basket, remove material from the auxiliary collectors 60, or to otherwise assist the person in the operator cabin to pick up more floating debris.

The vessel may be driven forward to collect floating debris in any area to which the vessel has access bearing in mind its beam. If the vessel is driven along side a pier or into a very narrow canal or slip the collection through the inlet opening will be substantially equal to the beam of the vessel and thus the vessel may pick up materials from immediately adjacent to a wall which itself is immediately adjacent to the side of the barge section of the vessel.

While the preferred embodiment as described herein has been fitted with two holds 20 and 22 and a single alternate rail section 108, it will be obvious to those skilled in this art that the vessel could be provided with a number of holds and additional switch sections to permit access to a plurality of such holds. In each particular case the operator will have to decide the optimum of vessel length and storage capacity balancing the usual factors of desirably increased storage capacity against the vessel cost to build and operate. While an endless cable operating over a drive pulley has been explained in association with the preferred embodiment, it will be obvious to those skilled in the art that various other forms of cable or chain drive may be utilized. It will also be apparent that the precise means of providing the flow pattern through the collection basin may be altered without departing from the scope of the invention. For the scope of the invention reference should be had to the following claims.

I claim:

1. A marine vessel for removing floating debris from the surface of a body of water, comprising:

(1) a hull;

(2) a collection basin having an inlet opening for flow of surface water into the basin and a means for flow of the surface water out of the basin;

(3) a collection basket disposable in the basin at a skimming position and having bottom and side walls and a meshed surface for flow of the surface water therethrough and for retaining the debris therein; and (4) a haulage means attached to the vessel for lifting and translating the collection basket from the skimming position to a dumping position such that debris collected by the collection basket is moved onto the vessel, said haulage means having a track extended from a first location adjacent said collection basket when in the skimming position, upwardly above the surface of the water and aft with respect to the vessel to a second location where the collection basket is emptiable to a storage hold located on the vessel.

2. The vessel of claim 1 wherein said collection basin has two outside walls and said vessel has side walls comprising the beam of said hull and wherein said outside walls of said collection basin have the same beam width as the beam width of said vessel.

3. The vessel of claim 2, wherein said collection basin has opposed inside walls, each said inside wall curving inwardly from a corresponding outside wall to define said inlet opening so that surface water may flow smoothly into said inlet opening.

4. A vessel in accordance with claim 1, wherein said track comprises at least one switch section so that said collection basket may be optionally emptied into at least one further storage hold located on said vessel.

5. The vessel of claim 4, wherein said at least one switch section of said track comprises a switch plate pivotally attached to a switch support and an alternate rail affixed to said switch plate for pivotal movement with said switch plate and means to pivot said switch plate about said pivot.

6. The vessel of claim 5 further characterized by said switch plate comprising a guide surface.

7. The vessel in accordance with claim 6, wherein said alternate rail is movable from a position aligned with said track to an alternate position by means of a hydraulic ram.

8. The vessel in accordance with claim 1, wherein said collection basket has at least one pair of wheels for rolling along said haulage means.

9. The vessel of claim 8, wherein said collection basket has a second pair of wheels for rolling along said haulage means.

10. A vessel in accordance with claim 1, wherein said vessel has a work platform located at the front of said collection basin and extending across the width of said collection basin for supporting a worker.

11. The vessel in accordance with claim 1, wherein said haulage means further comprising at least one cable guided to follow said track and attached to said basket adjacent an intersection of said bottom and one of said side walls of said basket for moving the collection basket along said track.

12. The vessel of claim 11, wherein said cable is guided to follow said track by a plurality of idler pulleys and said cable is driven by means of a drive pulley and said drive pulley is driven by a motor.

* * * * *